US008893452B2

(12) United States Patent
Hatzinikolas

(10) Patent No.: US 8,893,452 B2
(45) Date of Patent: Nov. 25, 2014

(54) TIE SYSTEM FOR CONNECTING A VENEER WALL TO A CEMENTITIOUS BACKUP WALL

(71) Applicant: Michael Hatzinikolas, Edmonton (CA)

(72) Inventor: Michael Hatzinikolas, Edmonton (CA)

( * ) Notice: Subject to any disclaimer, the term of this patent is extended or adjusted under 35 U.S.C. 154(b) by 0 days.

(21) Appl. No.: 13/758,606

(22) Filed: Feb. 4, 2013

(65) Prior Publication Data

US 2014/0150373 A1 Jun. 5, 2014

Related U.S. Application Data

(63) Continuation-in-part of application No. 13/693,911, filed on Dec. 4, 2012, now abandoned.

(51) Int. Cl.

| | |
|---|---|
| ***E04B 1/38*** | (2006.01) |
| ***E04B 2/00*** | (2006.01) |
| ***E04B 1/76*** | (2006.01) |
| ***E04B 1/41*** | (2006.01) |

(52) U.S. Cl.

CPC ..... *E04B 2/00* (2013.01); *E04B 1/7616* (2013.01); *E04B 1/4178* (2013.01)

USPC ..... 52/712

(58) Field of Classification Search

CPC . E04B 1/4178; E04B 1/185; E04B 2001/405; E04B 2002/565

USPC ..... 52/712

See application file for complete search history.

(56) References Cited

U.S. PATENT DOCUMENTS

| | | | | |
|---|---|---|---|---|
| 1,832,231 | A * | 11/1931 | Menninger | 52/378 |
| 1,924,724 | A * | 8/1933 | Olney | 52/379 |
| 3,353,312 | A | 11/1967 | Storch | |
| 3,568,389 | A * | 3/1971 | Gulow | 52/714 |
| 4,021,990 | A * | 5/1977 | Schwalberg | 52/479 |
| 4,373,314 | A * | 2/1983 | Allan | 52/434 |
| 4,606,163 | A * | 8/1986 | Catani | 52/434 |
| 4,825,614 | A * | 5/1989 | Bennett et al. | 52/410 |
| 4,843,776 | A | 7/1989 | Guignard | |
| 4,869,038 | A | 9/1989 | Catani | |
| 4,869,043 | A * | 9/1989 | Hatzinikolas et al. | 52/712 |
| 4,875,319 | A * | 10/1989 | Hohmann | 52/383 |
| 5,207,043 | A | 5/1993 | McGee et al. | |
| 5,392,581 | A * | 2/1995 | Hatzinikolas et al. | 52/712 |
| 5,671,578 | A * | 9/1997 | Hohmann | 52/562 |
| 6,128,883 | A * | 10/2000 | Hatzinikolas | 52/698 |
| 6,209,281 | B1 * | 4/2001 | Rice | 52/714 |
| 6,941,717 | B2 * | 9/2005 | Hohmann et al. | 52/506.01 |

(Continued)

FOREIGN PATENT DOCUMENTS

| | | |
|---|---|---|
| CA | 1294457 | 1/1992 |
| CA | 1306116 | 8/1992 |

*Primary Examiner* — Mark Wendell

*Assistant Examiner* — Keith Minter

(74) *Attorney, Agent, or Firm* — Kenneth Bousfield; Bereskin & Parr LLP/S.E.N.C.R.L., s.r.l.

(57) ABSTRACT

A connector system for a composite wall, the composite wall comprising a back-up wall and a veneer spaced apart from the back-up wall, the connector system comprising a backup wall connector and a spacer mountable on the backup wall connector. The backup wall connector comprising an inner anchoring end and an outer coupling end spaced from the inner anchoring end, the outer coupling end comprising a vertically extending slot. The spacer defines a plurality of vertically fixed positions in which a wall tie is selectively fixedly receivable.

15 Claims, 8 Drawing Sheets

(56) References Cited

U.S. PATENT DOCUMENTS

| | | | | |
|---|---|---|---|---|
| 6,973,756 | B2 * | 12/2005 | Hatzinikolas | 52/235 |
| 7,562,506 | B2 * | 7/2009 | Hohmann, Jr. | 52/714 |
| 7,654,058 | B2 * | 2/2010 | Hatzinikolas | 52/713 |
| 7,845,137 | B2 * | 12/2010 | Hohmann, Jr. | 52/714 |
| 8,051,621 | B2 * | 11/2011 | Hatzinikolas | 52/712 |
| 8,191,853 | B2 * | 6/2012 | Long, Sr. | 249/40 |
| 8,347,581 | B2 * | 1/2013 | Doerr et al. | 52/700 |
| 8,555,595 | B2 * | 10/2013 | Hatzinikolas | 52/699 |
| 2001/0054270 | A1 * | 12/2001 | Rice | 52/714 |
| 2004/0231270 | A1 * | 11/2004 | Collins et al. | 52/506.01 |
| 2006/0112659 | A1 * | 6/2006 | Lindner et al. | 52/712 |
| 2009/0193750 | A1 * | 8/2009 | Klima | 52/712 |
| 2010/0101175 | A1 * | 4/2010 | Hohmann | 52/698 |
| 2011/0239566 | A1 * | 10/2011 | Ciuperca et al. | 52/259 |
| 2013/0074432 | A1 * | 3/2013 | Ciuperca | 52/309.4 |

* cited by examiner

TIE SYSTEM FOR CONNECTING A VENEER WALL TO A CEMENTITIOUS BACKUP WALL

CROSS REFERENCE TO RELATED APPLICATION

This application is a continuation-in-part of co-pending U.S. patent application Ser. No. 13/693,911, filed on Dec. 4, 2012, which is incorporated herein by reference in its entirety.

FIELD

This invention relates to a connector system and method for connecting a veneer to a back-up wall. In a particularly embodiment, the invention relates to a connector system and method for connecting a veneer made from bricks or the like to a backup wall made from a, e.g., cementitious material such as concrete blocks, wherein a deformable layer, e.g., foam insulation, is provided on an outer side of the backup wall.

INTRODUCTION

Some buildings utilize an outer veneer. The outer veneer provides a decorative exterior but is not load supporting. For example, the outer veneer may be made from rows of bricks or the like. A backup wall is provided as the load supporting structure. Various different backup wall constructions are known including the use of cementitious material. The cementitious backup wall is sometimes poured on-site into a form or may be formed from concrete blocks. The backup wall may be covered with rigid insulation, such as molded or extruded foam insulation panels.

Connector systems are typically used to secure the veneer to the backup wall. See for example U.S. Pat. No. 8,051,621 wherein a connector system comprises backup wall connector that has an inner end for connecting to the backup wall, a form connector for connecting to the backup wall form, one or more fasteners for attaching the form connector to the backup wall form, and a wall tie that connects the outer end of the backup wall connector to the veneer wall. In this design, the wall tie is received in a vertically extending aperture and may travel upwardly and downwardly therein.

SUMMARY

A wall tie when correctly positioned or aligned will be able to support its entire design load. However, if the wall tie is not positioned generally horizontally, its load carrying capacity is reduced. Over the life of a building, various forces will be applied to the wall tie. For example, there may be relative vertical motion of the veneer and the backup wall thereby moving one end of the wall tie vertically with respect to the other. In addition, wind impinging on the veneer wall may apply an inward force to the wall tie. The connector system is accordingly preferably designed so that the wall tie will tend to remain correctly aligned despite these forces.

A connector system comprises a backup wall connector, which has a first or inner end that is securable to the backup wall and a second or outer end that receives an inner end of a wall tie. Accordingly, the backup wall connector provides a secure base to which a wall tie is mountable. The outer end of the wall tie is secured to the veneer and therefore secures the veneer in position with respect to the backup wall. In accordance with an aspect of the design disclosed herein, the connector system is configured to secure the wall tie at a fixed position with respect to the backup wall connector during normal loading applied to an outer surface of the veneer (e.g., due to wind impinging thereon) but to permit the inner end of the wall tie to move vertically due to differential vertical movement of the veneer and the backup wall.

In accordance with one aspect, there is provided a connector system for a composite wall, the composite wall comprising a back-up wall and a veneer spaced apart from the back-up wall, the connector system comprising:

(a) a backup wall connector comprising:
  (i) an inner anchoring end; and
  (ii) an outer coupling end spaced from the inner anchoring end, the outer coupling end comprising a vertically extending slot; and (b) a spacer mountable on the backup wall connector, wherein the spacer defines a plurality of vertically fixed positions in which a wall tie is selectively fixedly receivable.

Accordingly, during installation, the inner end of the backup wall connector may be secured to a backup wall with the spacer positioned on the backup wall connector. For example, the backup wall may be a concrete block wall, a poured cementitious wall, a wood framed wall or other backup wall that is known in the art wherein a rigid insulation layer (a panel or the like) is provided on the outer side of the backup wall. In such a case, the backup wall connector may be secured to the backup wall by any method known in the art, such as by securing the backup wall connector in mortar securing a block concrete wall together or using screws or the like to secure the backup wall connector to a backup wall. Alternately, the backup wall may be made from cementitious material that is poured into a wall form that is made of, e.g., rigid insulation. In such a case, the spacer, (which may be referred to in this case as a form connector) may be secured to the wall form and the backup wall connector inserted through a slot in the form connector into a void space behind the form in which cementitious material is poured.

The spacer/form connector is preferably positioned so that the spacer/form connector inhibits movement of the wall tie out of a vertically fixed position during normal loading applied to the exterior surface of the veneer. For example, the spacer may have a plurality of horizontal grooves on its outer surface that are sized for at least partially receiving the inner end of the wall tie therein. Further, the spacer/form connector may be positioned to overlie part of the slot. Accordingly, when seated in a groove and the spacer is so positioned, the inner end of the wall tie will be inhibited from upward or downward motion in the slot.

However, if a sufficient force is applied to the spacer, then the spacer may be pushed inwardly (e.g., into the foam insulation). This movement moves the spacer rearwardly and opens up the slot thereby enabling the wall tie to slide vertically in the slot. Preferably, the spacer is flexible, for example, it may be made of plastic. Therefore, if the wall tie presses inwardly a sufficient amount on the portion of the spacer against which it is seated, that portion may deflect inwardly into the foam insulation an amount such that inner end of the wall tie is moveably vertically in the slot of the backup wall connector. Alternately, the spacer may be rigid. The spacer may overlie a deformable material, e.g., insulation such as Styrofoam insulation. Accordingly, when the wall experiences differential movement, the wall tie may have sufficient pressure applied to it to compress the insulation and thereby permit the wall tie to move vertically so that the wall tie is generally horizontally disposed. Accordingly, the design accommodates differential movement and permits correction of misalignment of the wall tie due to the differential movement without affecting structural performance of the connector system.

In operation, the backup wall connector may be secured to the backup wall and the spacer provided. The wall tie may then be inserted into the slot and moved to the desired vertical height (i.e., placed in one of the vertically fixed positions), which is preferably generally horizontal. If the wall tie is not in the appropriate alignment (preferably generally horizontal), then the load bearing capacity of the connector system will be reduced. The spacer/form connector may therefore be used to secure the wall tie in position with respect to the backup wall connector (i.e., to maintain the wall tie in the selected vertically fixed position) until the outer end of the wall tie is secured in position in the veneer wall. For example, the form connector may be fixed to the form (e.g., the wall form may made from foamed material that is maintained in position when the backup wall is formed) or to a covering over the wall form, such as an insulation layer. This limits the inward motion of the form connector. The form connector may accordingly be positioned so as to inhibit, and optionally prevent, the wall tie from moving rearwardly out of a vertically fixed position thereby inhibiting vertical motion of the wall tie in the slot during normal loading applied to the exterior surface of the veneer. However, if there is differential vertical movement of the veneer and the backup wall, then the vertical force applied to the wall tie may be sufficient to cause the inner end of the wall tie to push inwardly on the spacer a sufficient amount to compress the insulation and enable the inner end of the wall tie to move vertically to, e.g., the next adjacent upper or lower groove. The vertical force applied to the wall tie will then be reduced, preferably to an extent such that the inner end of the wall tie is again fixed in position and the inner pressure on the form connector has been reduced or eliminated.

A plurality of recesses may be provided on an outward facing side of the spacer. Accordingly, to move vertically, the inner end of the wall tie must move out of the recess by the wall tie compressing the insulation layer by pressing on the spacer. When the wall tie is in a new position, the inner end of the wall tie may move outwardly and the spacer may rebound to its starting position due to the insulation rebounding when the compressive force is withdrawn. Thus the inner end of the wall tie may be positioned in a new recess.

The spacer may comprise an opening and is slidably receivable on the outer coupling end. Preferably, the opening has a vertical height that is approximately equal to a vertical height of the outer coupling end.

In some embodiments, the wall tie has a thickness, a plurality of recesses are provided on an outward facing side of the spacer and the recesses have a depth between 0.1 and 2.0 times the thickness of the wall tie.

The spacer may further comprise inwardly extending spikes on an inner side of the spacer. These spikes may assist in securing the spacer in position on, e.g., the insulation of the backup wall.

The vertically extending slot may comprise:

(a) an outward facing inner side;

(b) an inward facing outer side; and, (c) the outward facing inner side and the inward facing outer side are spaced apart by a distance sufficient to permit the wall tie to freely slide within the slot.

In some embodiments, when the wall tie is received in the slot and the spacer is mounted on the backup wall connector, the spacer is positioned to abut the wall tie.

The backup wall connector may further comprise a spacer comprising an opening, wherein the spacer is slidably receivable on the outer coupling end. Preferably, the opening has a vertical height that is approximately equal to a vertical height of the outer coupling end. Alternately, or in addition, the spacer may further comprise inwardly extending spikes on an inner side of the spacer.

The wall tie may have a thickness and the recesses may have a depth between 0.1 and 2.0 times the thickness of the wall tie.

The vertically extending slot may comprise:

(a) an outward facing inner side;

(b) an inward facing outer side and, (c) the outward facing inner side and the inward facing outer side are spaced apart by a distance sufficient to permit the wall tie to freely slide within the slot wherein, preferably, when the wall tie is received in the slot and the spacer is mounted on the backup wall connector, the spacer is positioned to abut the wall tie.

Preferably, the spacer comprises a form connector.

The spacer may be mountable on the first backup wall connector in a first orientation and on a second backup wall connector in a second orientation and, in the first orientation, the spacer may define a larger number of vertically fixed positions in which the wall tie is selectively fixedly receivable then when the spacer is mounted on the backup wall connector in the second orientation.

The spacer may have a first opening for receiving the outer coupling end of the first backup wall connector, a second opening for receiving an outer coupling end of the second backup wall connector and a plurality of recesses are provided on an outward facing side of the spacer along at least a portion of each opening.

The first opening may be longer than the second opening. Alternately, or in addition, the first opening may have a greater number of recesses then the second opening.

DRAWINGS

For a better understanding of the present invention and to exemplify how it may be carried into effect, reference will now be made, by way of example only, to the accompanying drawings, in which.

Figure 6:
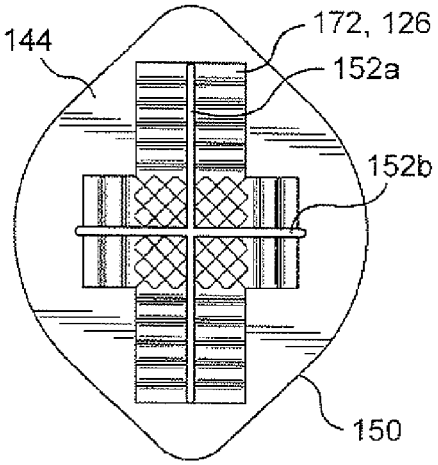
FIG. 6 is a plan view of an alternate embodiment of a form connector in a first orientation.
Figure 8A:
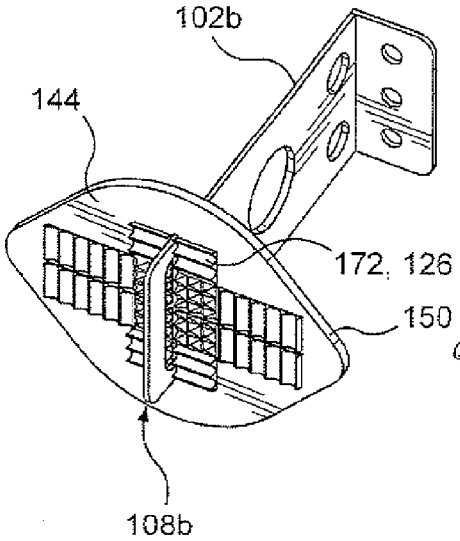
Figure 8B:
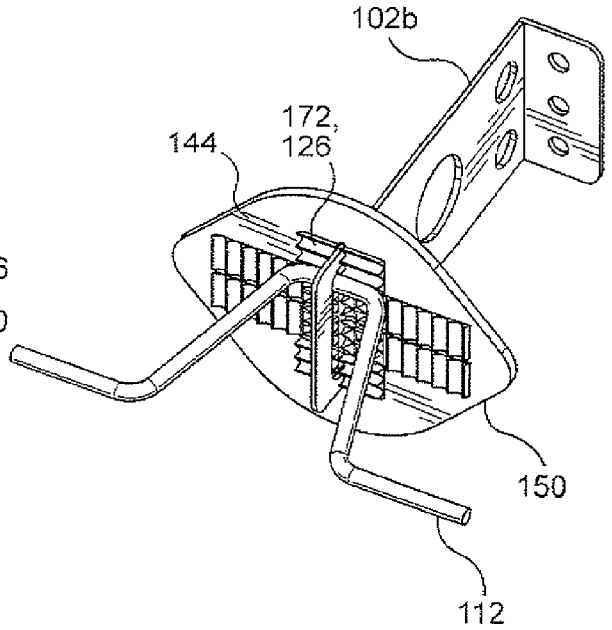
Figure 9A:
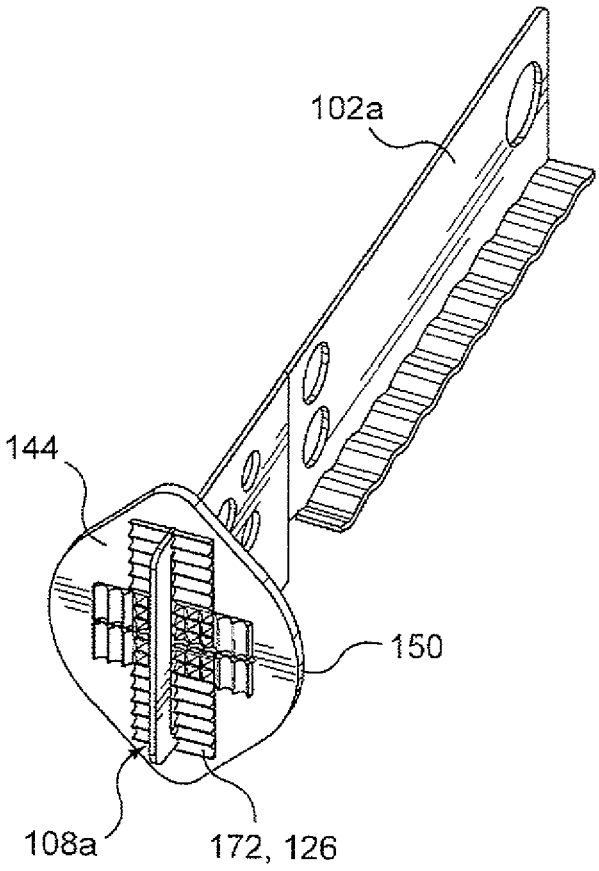
Figure 9B:
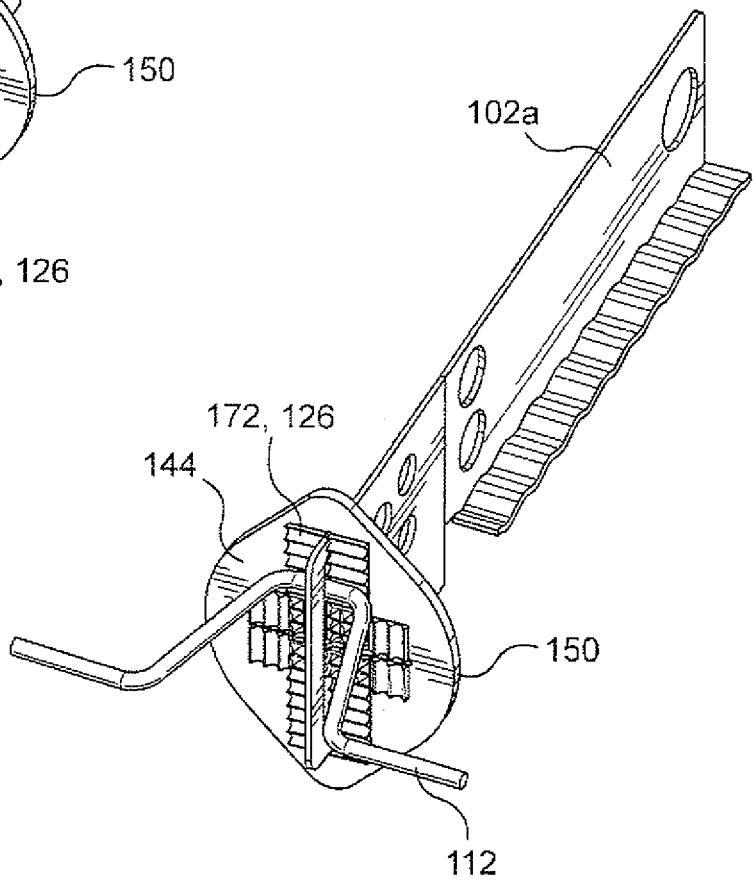

FIG. 8*a* is a perspective view of the form connector of FIG. 6 in the second orientation mounted on a backup wall connector;

FIG. 8*b* is a perspective view of the form connector of FIG. 6 in the second orientation mounted on a backup wall connector and with a tie connector installed;

FIG. 9*a* is a perspective view of the form connector of FIG. 6 in the first orientation mounted on an alterante backup wall connector; and, FIG. 9*b* is a perspective view of the form connector of FIG. 6 in the first orientation mounted on an alternate backup wall connector and with a tie connector installed.

DESCRIPTION OF VARIOUS EMBODIMENTS

Figure 1:
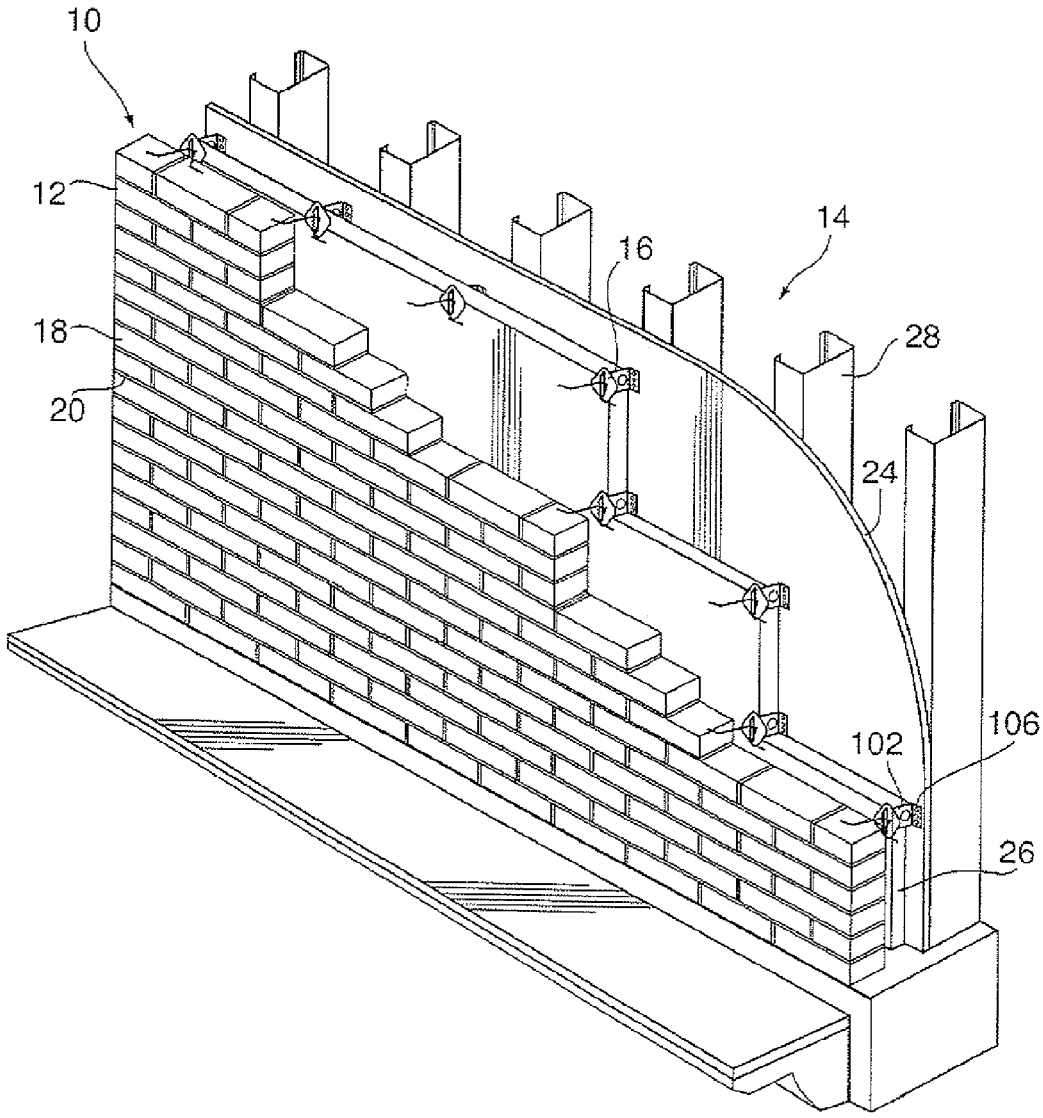
FIG. 1 is a partially cut away perspective view of an exemplary composite wall using an embodiment of the connector system wherein the backup wall connector is L-shaped.

FIG. 1 shows an example of a composite wall 10. In the example shown, composite wall 10 comprises a veneer 12 secured to backup wall 14 using connector system 16. In some cases, as exemplified, veneer 12 may be spaced apart from backup wall 14. This wall configuration is sometimes referred to as a "cavity wall".

Veneer 12 may be any veneer that is known in the art and is secured in position by a connector system. As exemplified, veneer 12 is a masonry wall which comprises a plurality of bricks 18 and mortar 20. In some cases veneer 12 may comprise one or more of stone, marble, granite, travertine, limestone, cast stone, concrete blocks, glass blocks, stucco and tile.

Backup wall 14 may be any backup wall that is used with a connector system. Accordingly, the backup wall may comprise one or more of masonry, wood, steel or other building materials. The backup wall may be constructed from concrete blocks or poured concrete.

In the example shown, backup wall 14 comprises steel framing studs 28, sheathing 24 and insulation 26. The sheathing 24 and insulation 26 are positioned in the space between the veneer 12 and steel framing studs 28. Sheathing 24 may be any material known in the art and may comprise one or more of plywood boards, fibreboards, wafer boards or polyurethane boards, for example. Insulation 26 may be any material known in the art that is rigid but at least somewhat resiliently deformable. The insulation is preferably a foamed insulation such as polystyrene board.

It will be appreciated that composite wall 10 may further comprise one or more additional layers in addition to the veneer 12 and the backup wall 14 such as a waterproofing layer.

Figure 2:
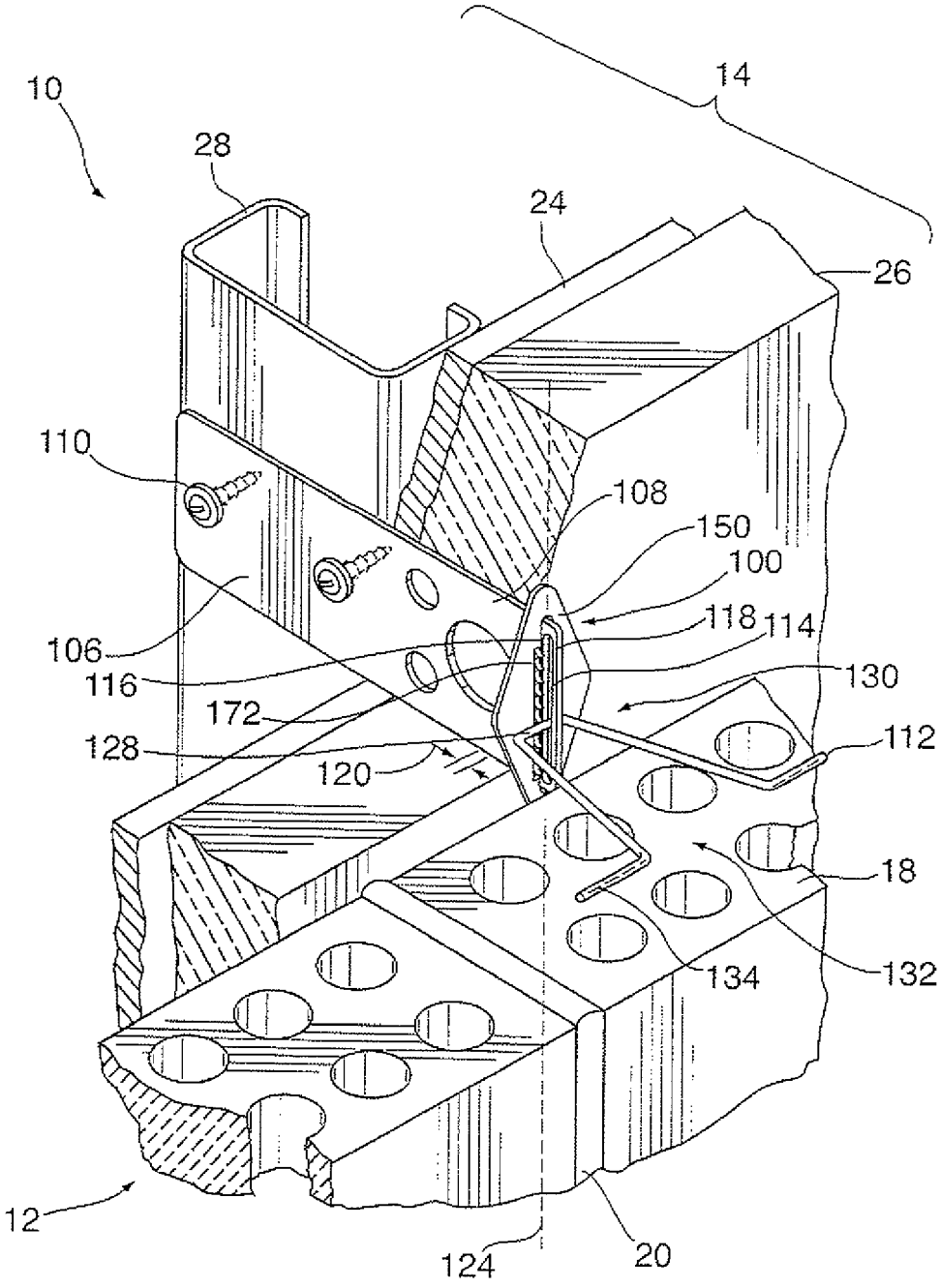
FIG. 2 is an enlarged partially cutaway perspective view of the connector system and composite wall of FIG. 1 wherein the backup wall connector is linear and is secured to the backup wall by screws.

FIG. 2 shows a partial cutaway view of one embodiment of a connector system 100 comprising a backup wall connector 102 and a wall tie 112 installed in composite wall 10.

Backup wall connector 102 has an inner anchoring end 106 and an outer coupling end 108. Inner anchoring end 106 may be of any configuration known in the art and is configured to be securable to the backup wall 14. In the example shown, inner anchoring end 106 comprises a plurality of holes (not shown) through which fasteners 110 extend and secure to the steel framing studs 28. In some cases, inner anchoring end 106 may be configured differently according to the type of backup wall 14. As exemplified in FIG. 1, inner anchoring end 106 is L shaped and is secured to sheathing 24. As exemplified in FIG. 3A, inner anchoring end 106 is provided with flanges receivable in the mortar that secured masonry blocks 30 in position. Alternately, the inner end may be configured to be received into a form into which concrete is to be poured.

Outer coupling end 108 is configured to receive a wall tie 112. As exemplified, outer coupling end 108 comprises an opening or vertically extending slot 114 that is sized to receive a wall tie 112. The wall tie 112 has an inner end 130 that is securable to outer coupling end 108 and an outer end 132 that is securable to veneer 12.

In some cases veneer 12 may comprise courses (or rows) of blocks 18 separated by mortar 20. Outer end 132 of wall tie 112 may be positionable inside the mortar 20 so that when the mortar cures, wall tie 112 is permanently encased in mortar 20 and therefore secured in veneer 12. Accordingly, outer end 132 may comprise a pair of oppositely extending legs 134. Outer end 132 may be of any configuration that provides a secure attachment of wall tie 112 to veneer 12.

Inner end 130 of wall tie 112 may be of any configuration that is receivable in slot 114. Preferably, as exemplified, inner end 130 is generally a U shaped portion 128. Accordingly, once backup wall connector 14 is positioned in place and the desired outer layers positioned thereover, one leg 134 may be inserted into slot 114 and wall tie manipulated such that the U shaped portion 128 is positioned in slot 114.

In some cases, wall tie 112 may be selectively positionable inside an opening in outer coupling end 108. For example, outer coupling end 108 may comprise a slot 114 and wall tie 112 may be selectively positionable within slot 114. In the example shown, slot 114 comprises an outward facing inner side 116 and an inward facing outer side 118. The two sides 116 and 118 of the slot 114 may be spaced apart by a distance sufficient to permit the received wall tie 112 to freely slide within the slot 114. For example, a width of slot 114 (e.g. defined by the space between the two sides 116 and 118) along at least a portion of the length of slot 114 may be greater than a thickness 120 of wall tie 112.

Figure 4:
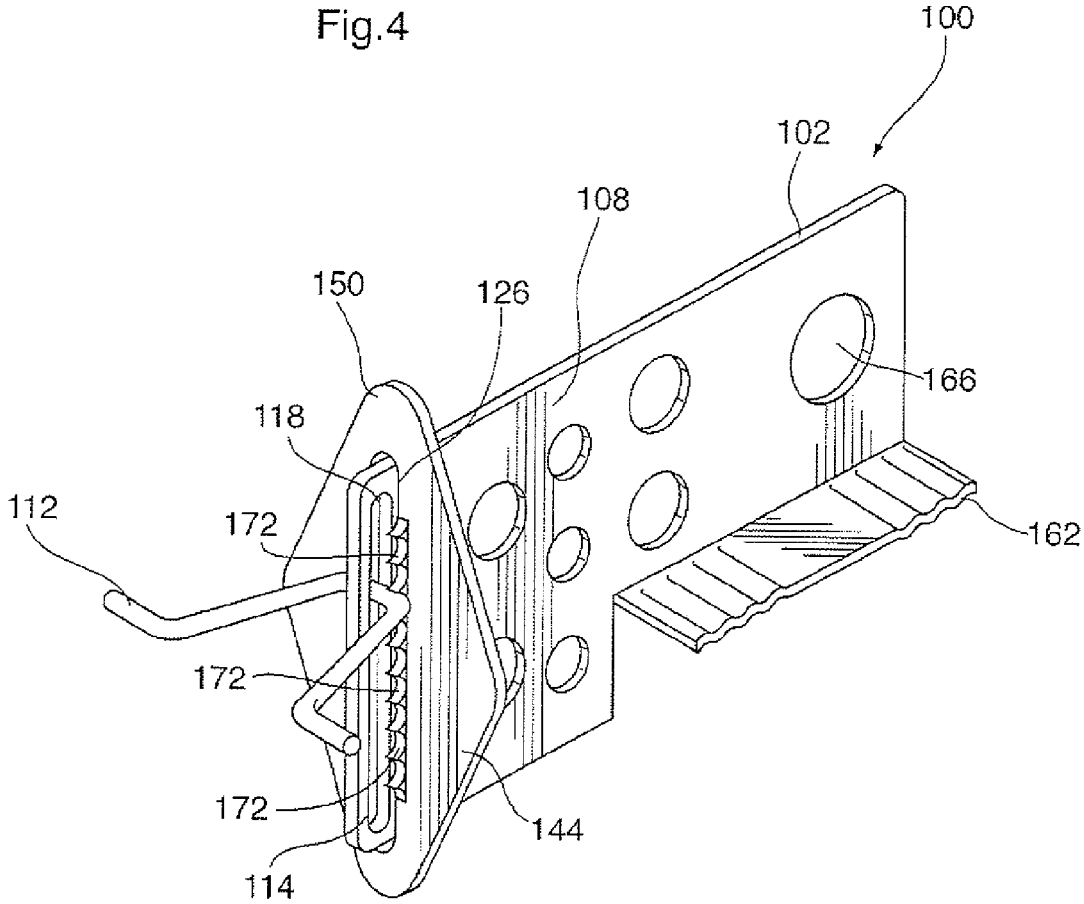
FIG. 4 is a perspective view of the connector system of FIG. 3A in isolation from the composite wall.

Wall tie 112 is selectively fixedly receivable in one of a plurality of vertically fixed positions in outer coupling end 108. As exemplified, slot 114 has a vertically extending axis 124. A plurality of vertically fixed positions (see e.g., positions 172 in FIG. 4) are provided in which wall tie 112 is selectively receivable. Vertically fixed positions 172 may be formed as a plurality of outwardly facing recesses 126 provided on spacer 150. As exemplified in FIG. 4, recesses 126 are provided on outer side 144 of spacer 150. Accordingly inward facing outer side 118 and recesses 126 define a plurality of vertically fixed positions 172 in which wall tie 112 may be selectively fixedly receivable. Inner end 130 of the wall tie 112 may be moved vertically in slot 114 until the U-shaped portion 128 is at a desired height and the U shaped portion 128 may then be inserted into the appropriate recess. Recesses 126 may be sized to receive at least a portion of wall tie 112. For example, recesses 126 may have a depth that is between 0.1 and 2.0 times a thickness 120 of wall tie 112.

In some cases recess 126 may be configured so as to inhibit movement of U-shaped portion 128 out of recess 126 during normal loadings on the exterior surface of the veneer 12. For example, recesses 126 may have a sufficient depth such that, in normal conditions, U-shaped portion 128 will not move sufficiently rearwardly so as to deflect spacer 150 sufficiently rearwardly and be able to move vertically therein. Accordingly, wall tie 112 may be received in a recess or vertically fixed position 172 so as to resist vertical movement relative to backup wall connector 102 if veneer 12 moves inwardly due to wind impinging on the outer surface of veneer 12.

Backup wall connector 102 may extend at least partially across the space between veneer 12 and backup wall 14. For example, backup wall connector 106 in FIG. 2 is shown extending essentially across the entire space between veneer 12 and backup wall 14 and protruding through sheathing 24 and insulation 26. In other cases, it may extend a short amount from the backup wall 14.

As exemplified, a spacer is provided on outer coupling end 108. For example, a spacer 150 is exemplified in FIGS. 2, 3, 3A, 3B, 3C and 4. A form connector 150 is exemplified in FIG. 5 as, in this embodiment, the backup wall includes a wall form and the spacer may be referred to as a form connector. As exemplified in FIG. 5, backup wall 14 comprises poured cementitious material 32 which is positioned inside form 34. Form 34 is preferably left in position when the backup wall cures and may be made from, Styrofoam™ insulation or other rigid insulation. Form connector 150 is preferably configured to abut U-shaped portion 128 when U-shaped portion 128 is received in a recess 126. Accordingly, the form connector may be positioned on outer coupling end 108 between backup wall 14 and U-shaped portion 128 so as to inhibit the movement of wall tie 112 out of a recess 126.

For example, referring to the embodiments of in FIGS. 2, 3, 3A, 3B, 3C and 4, the spacer/form connector may have a slot so as to be slidingly receivable on outer coupling end 108. Accordingly, once backup wall connector 102 is secured to backup wall 14 such as by placing it in the mortar or securing it in position by screws and insulation 26 is placed thereover, the spacer may be slid onto outer coupling end 108 and moved rearwardly to, e.g., abut backup wall 14. The wall tie 112 may then be inserted into slot 114*i* at a desired position. The spacer is preferably positioned (e.g., it overlies a sufficient portion of slot 114) so that U-shaped portion 128 is not freely vertically moveable therein. Therefore, if the U-shaped portion 128 moves rearwardly, it will engage the spacer and be inhibited from vertical motion. Thus U-shaped portion 128 is secured in a fixed vertical position 172 with respect to backup wall connector 102.

Figure 5:
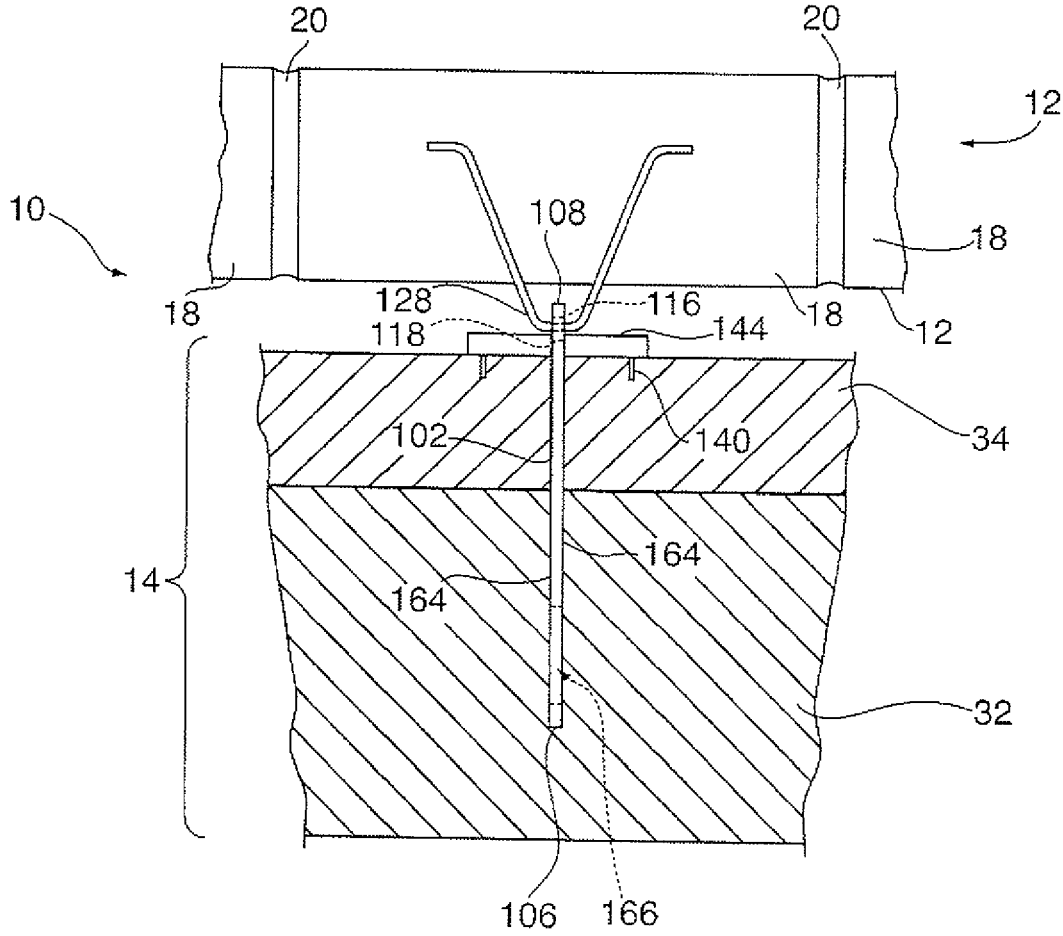
FIG. 5 is a horizontal cross-sectional view through a composite wall have a poured concrete backup wall

Similarly, form connector 150 may be secured to form 34, which is preferably deformable (see FIG. 5). Cementitious material may then be poured into the form and cured. The wall tie 112 may then be inserted into slot 114 at a desired vertical fixed position 172.

It will be appreciated (as exemplified in FIG. 5) that the thickness of the spacer or form connector is preferably selected so as to overlie a portion of slot 114 when installed on backup wall connector 102. Preferably, the thickness is uniform. Preferably, the spacer is flexible (i.e., it may bow inwardly if U-shaped portion 128 presses inwardly against it) and, preferably, it is made of plastic.

Figure 3A:
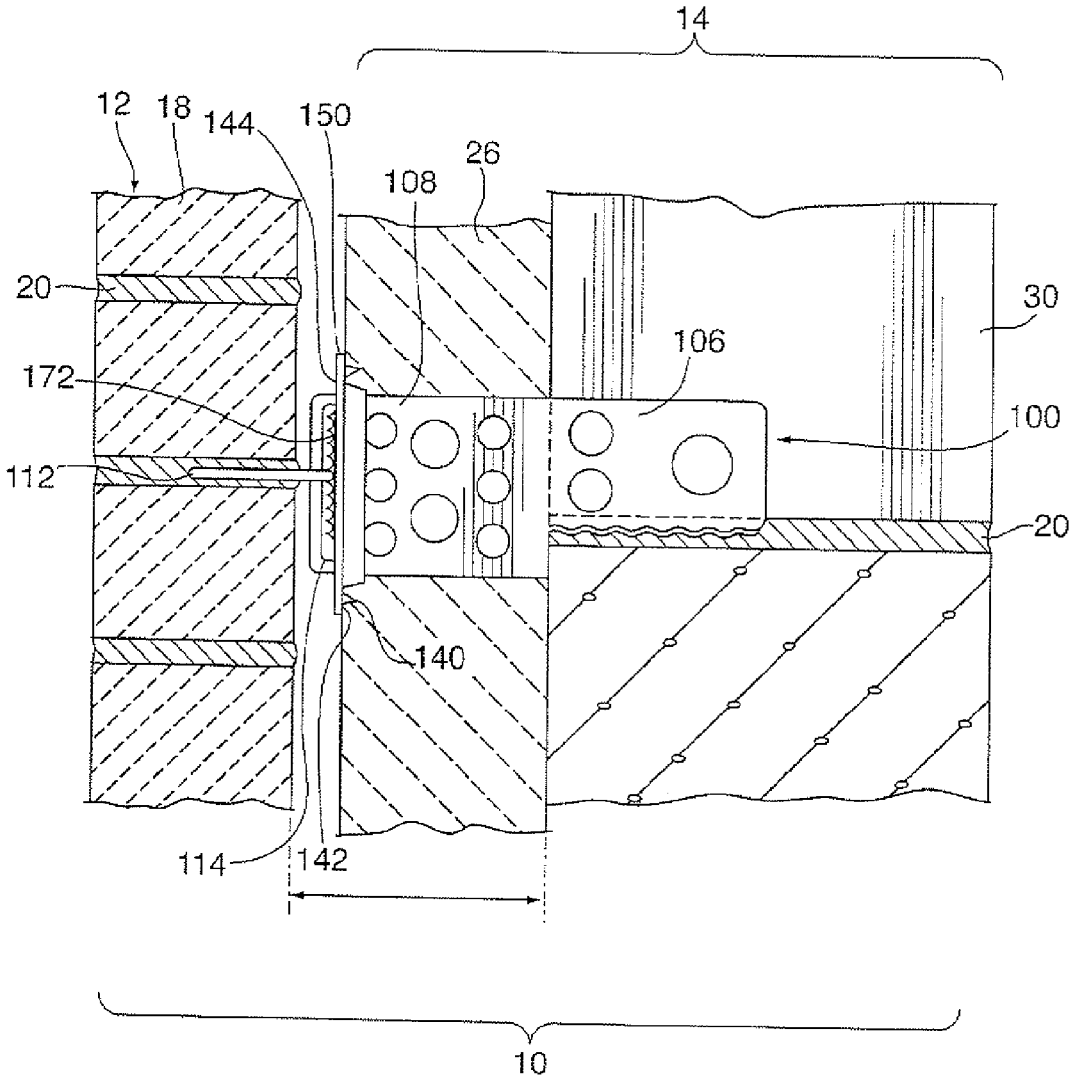
FIG. 3A is a vertical cross-sectional view of the composite wall of FIG. 1 showing an installed connector system wherein the backup wall connector is linear and is secured to the backup wall by flanges that are secured in the mortar between adjacent blocks.

FIG. 3A exemplifies a connector system 100 used with a masonry backup wall comprising masonry blocks 30 and mortar 20. In this embodiment, inner anchoring end 106 is configured to be anchored in masonry backup wall 14. In the example shown, inner anchoring end 106 comprises a vertical portion 160 having opposed planar sides 164 and one or more horizontal projections or flanges 162. Vertical portion 160 may be positioned between horizontally adjacent masonry blocks 30 and horizontal projections 162 may be positioned between vertically adjacent masonry blocks 30. In some cases, inner anchoring end 106 may be configured in other suitable ways for anchoring to masonry backup wall 14 such as being provided with one or more openings 166 for receiving mortar therein. It will be appreciated that the rest of connector system 100 may be the same as that previously discussed with respect to FIG. 2.

In this embodiment, connector system 100 also comprises a spacer 150. Spacer 150 is mountable on backup wall connector 102. For example, spacer 150 may comprise an opening 152 and spacer 150 may be slidably receivable on outer coupling end 108. In the example shown, opening 152 comprises a closed slot. In some cases opening 152 may comprise an open slot or a differently shaped opening.

Figure 3B:
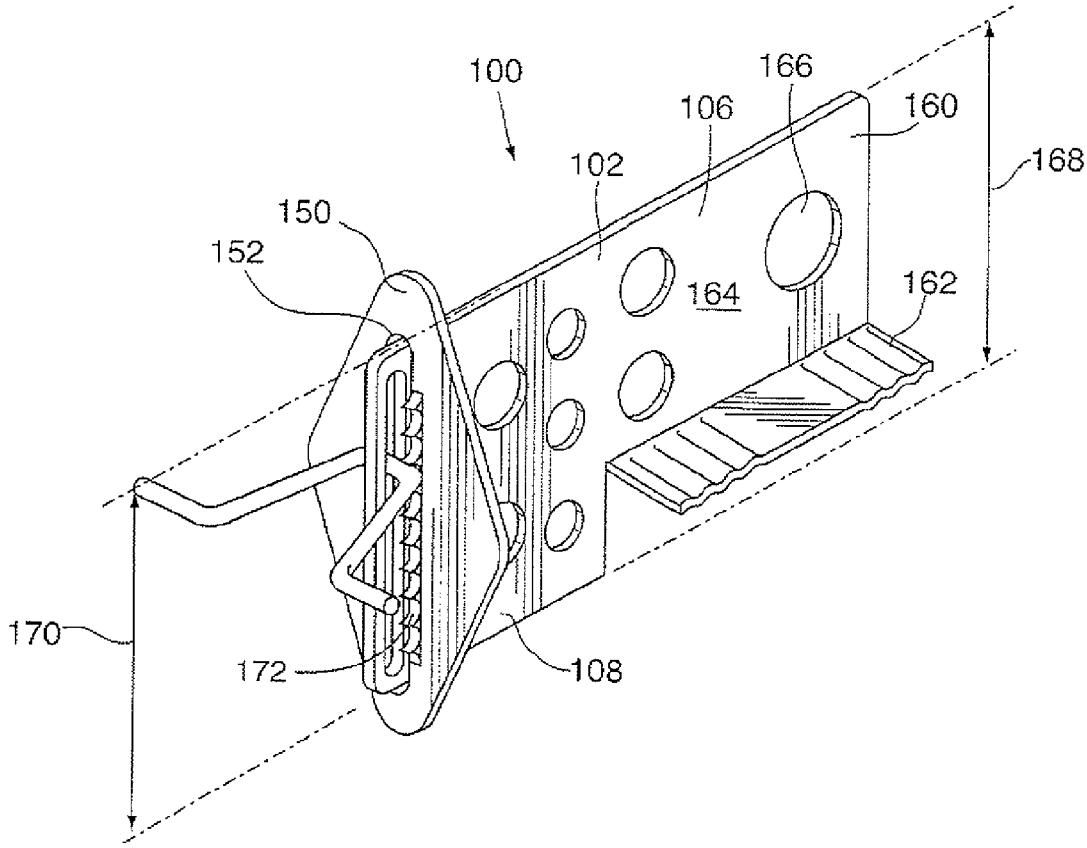
FIG. 3B is a perspective view of the connector system of FIG. 3A in isolation from the composite wall.

Opening 152 is sized to receive outer coupling end 108. Preferably, opening 152 is sized to closely conform to the size of outer coupling end 108 so that, once positioned on outer coupling end 108, spacer 150 is essentially fixed in a vertical and lateral position with respect to backup wall connector 102. In other words, spacer 150 may be moved inwardly and outwardly along backup wall connector 102 but may not be moved in a direction transverse thereto. Referring to FIG. 3B, vertical height 168 of outer coupling end 108 may be approximately equal to vertical height 170 of opening 152. A close fit between opening 152 and outer coupling end 108 permits spacer 150 to be slidably positionable on outer coupling end 108 during installation of the connector system 100. Accordingly, once backup wall connector 102 is mounted to backup wall 14 and spacer 150 is positioned on backup wall connector 102, spacer 150 is essentially fixed in a vertical and lateral position Preferably, spacer 150 is securable in position. Accordingly, as exemplified, spacer 150 may comprise spikes 140 on an inner side 142 which pierce insulation 26 (see FIG. 3A). Spikes 340 may help to keep backup wall connector 102 fixed in position during installation when mortar 20 of the backup wall 14 has not yet dried.

The recesses are preferably evenly sized and distributed along the outward facing side of spacer 150. In some cases, the recesses may be unevenly sized and/or unevenly distributed along.

Figure 7:
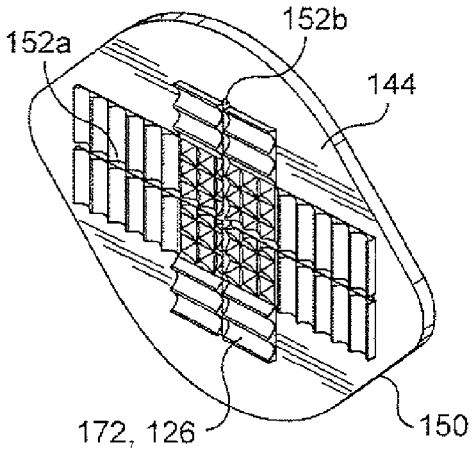
FIG. 7 is a perspective view of the alternate embodiment of the form connector of FIG. 6 in a second orientation.

An alternate embodiment of a spacer or form connector 150 is shown in FIGS. 6 and 7. As shown, spacer 150 has a first opening 152*a* and a second opening 152*b*. Preferably, each opening 152*a*, 152*b* are different lengths. In the first orientation shown in FIG. 6, opening 152*a*, which is the longer opening, extends vertically. In the second orientation shown in FIG. 7, opening 152*b*, which is the shorter opening, extends vertically. Accordingly, when form connector 150 is installed in the first orientation on backup wall connector 102*a* (see FIGS. 9*a* and 9*b*), wall tie 112 may be seated in any of the grooves or recesses 126 that extend horizontally. Alternately, when form connector 150 is installed in the second orientation on backup wall connector 102*b* (see FIGS. 8*a* and 8*b*), wall tie 112 may be seated in any of the grooves or recesses 126 that extend horizontally. As the form connector 150 has a greater number of grooves 126 in the first orientation, the tie connector 112 has a greater number of grooves 126 in which it may be seated when form connector is mounted in the first orientation.

As exemplified, backup wall connector 102*a* has an outer coupling end 108*a* that has a greater height then the outer coupling end 108*b* of backup wall connector 102*b*. Backup wall connector 102*b* may be installed in the back up wall and the facing wall may be installed at the same time. In such a case, the position of the wall tie when it is positioned horizontally may be able to be easily determined. In such a case, less vertical adjustability may be required. Accordingly, a backup wall connector 102*b* with a shorter outer coupling end 108*b* may be used. Accordingly, form connector 150 may be installed in the second orientation. However, in some case the facing wall may be installed after the backup wall, with the backup wall connectors, is constructed. In such a case, more vertical adjustability of the position of the wall tie 112 may be required. Accordingly, a backup wall connector 102*a* with a taller outer coupling end 108*a* may be used. In this case, form connector 150 may be installed in the first orientation to provide a larger number of recesses 126 that may be utilized.

It will be appreciated that recesses 126 need not extend along the entire length of openings 152*a* and 152*b*.

The embodiments described herein have been presented for the purposes of illustration and are not intended to be exhaustive or limiting. Many variations and modifications are possible in light of the foregoing teachings. The invention is limited only by the following claims.

The invention claimed is:

1. A connector system for a composite wall, the composite wall comprising a back-up wall and a veneer spaced apart from the back-up wall, the connector system comprising:

i) a first backup wall connector having:

(a) an inner anchoring end; and (b) an outer coupling end spaced from the inner anchoring end, the outer coupling end having a vertically extending slot defined therein for admission of a wall tie; and ii) a spacer, the spacer and the outer coupling end of the first backup wall connector being matingly engageable, the spacer defining a plurality of vertically fixed positions in which to receive the wall tie.

2. The system of claim 1 wherein a plurality of recesses are provided on an outward facing side of the spacer.

3. The system of claim 2 wherein the spacer has an opening through which slidably to receive the outer coupling end.

4. The system of claim 1 wherein the opening has a vertical height that is approximately equal to a vertical height of the outer coupling end.

5. The system of claim 1 wherein the wall tie has a thickness, a plurality of recesses are provided on an outward facing side of the spacer and the recesses have a depth between 0.1 and 2.0 times the thickness of the wall tie.

6. The system of claim 1 wherein the spacer further comprises inwardly extending spikes on an inner side of the spacer.

7. The system of claim 1 wherein the vertically extending slot has:

a. an outward facing inner side;

b. an inward facing outer side and, c. the outward facing inner side and the inward facing outer side are spaced apart by a distance sufficient to permit the wall tie to freely slide within the slot.

8. The system of claim 7 wherein a plurality of recesses are provided on an outward facing side of the spacer.

9. The system of claim 1 wherein, when the wall tie is received in the slot and the spacer is mounted on the backup wall connector, the spacer is positioned to abut the wall tie.

10. The system of claim 1 wherein the spacer comprises a form connector.

11. The system of claim 1 wherein, the spacer is mountable on the first backup wall connector in a first orientation and on a second backup wall connector in a second orientation and, in the first orientation, the spacer defines a larger number of vertically fixed positions in which the wall tie is selectively fixedly receivable than when the spacer is mounted on the backup wall connector in the second orientation.

12. The system of claim 11 wherein the spacer has a first opening for receiving the outer coupling end of the first backup wall connector, a second opening for receiving an outer coupling end of the second backup wall connector and a plurality of recesses are provided on an outward facing side of the spacer along at least a portion of each opening.

13. The system of claim 12 wherein the first opening is longer than the second opening.

14. The system of claim 13 wherein the first opening has a greater number of recesses then the second opening.

15. The system of claim 12 wherein the first opening has a greater number of recesses then the second opening.

* * * * *